US009260775B2

(12) United States Patent
Moyer

(10) Patent No.: US 9,260,775 B2
(45) Date of Patent: Feb. 16, 2016

(54) LOW ALLOY STEEL CARBURIZATION AND SURFACE MICROALLOYING PROCESS

(71) Applicant: Kenneth H. Moyer, Cinnaminson, NJ (US)

(72) Inventor: Kenneth H. Moyer, Cinnaminson, NJ (US)

( * ) Notice: Subject to any disclaimer, the term of this patent is extended or adjusted under 35 U.S.C. 154(b) by 0 days.

(21) Appl. No.: 14/103,789

(22) Filed: Dec. 11, 2013

(65) Prior Publication Data

US 2015/0159259 A1 Jun. 11, 2015

Related U.S. Application Data

(63) Continuation-in-part of application No. 13/336,723, filed on Dec. 23, 2011, now Pat. No. 8,696,830.

(51) Int. Cl.

| | |
|---|---|
| ***C23C 8/22*** | (2006.01) |
| ***C21D 1/00*** | (2006.01) |
| ***C21D 1/18*** | (2006.01) |
| ***C22C 38/00*** | (2006.01) |
| ***C22C 38/04*** | (2006.01) |
| ***C22C 38/08*** | (2006.01) |
| ***C22C 38/12*** | (2006.01) |
| ***C22C 38/14*** | (2006.01) |
| ***C22C 38/16*** | (2006.01) |
| ***C22C 38/18*** | (2006.01) |
| ***C22C 38/20*** | (2006.01) |
| ***C22C 38/22*** | (2006.01) |
| ***C22C 38/24*** | (2006.01) |
| ***C22C 38/26*** | (2006.01) |
| ***C22C 38/28*** | (2006.01) |
| ***C22C 38/38*** | (2006.01) |
| ***C22C 38/40*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/58*** | (2006.01) |

(52) U.S. Cl.

CPC ... *C23C 8/22* (2013.01); *C21D 1/00* (2013.01); *C21D 1/18* (2013.01); *C22C 38/001* (2013.01); *C22C 38/002* (2013.01); *C22C 38/005* (2013.01); *C22C 38/04* (2013.01); *C22C 38/08* (2013.01); *C22C 38/12* (2013.01); *C22C 38/14* (2013.01); *C22C 38/16* (2013.01); *C22C 38/18* (2013.01); *C22C 38/20* (2013.01); *C22C 38/22* (2013.01); *C22C 38/24* (2013.01); *C22C 38/26* (2013.01); *C22C 38/28* (2013.01); *C22C 38/38* (2013.01); *C22C 38/40* (2013.01); *C22C 38/42* (2013.01); *C22C 38/44* (2013.01); *C22C 38/46* (2013.01); *C22C 38/48* (2013.01); *C22C 38/50* (2013.01); *C22C 38/58* (2013.01); *C23C 2222/00* (2013.01)

(58) Field of Classification Search

CPC ..... C23C 8/22; C23C 8/32

See application file for complete search history.

*Primary Examiner* — Jessee Roe

(74) *Attorney, Agent, or Firm* — Craig M. Bell; Bell IP Law

(57) ABSTRACT

The present invention is directed to a process for carburizing low alloy steel in a vacuum furnace in the presence of a hydrocarbon carburizing gas in combination with hydrogen wherein said carburizing gas/hydrogen combination is administered to the vacuum furnace by cyclically reducing the pressure in the furnace followed by the pulsed addition of the hydrocarbon carburizing gas consisting of an acetylene/hydrogen gas mixture in a ratio of from about 1:1 to about 1:10 at increased temperature disassociate the carbon from the gas and deposit it only on the surface of said steel and not on the surface of the furnace. The continued application of increased temperature at reduced pressure causes the deposited carbon to diffuse below the surface of the steel towards the core resulting in a carburized low alloy steel product with increased hardness, ductility and improved resistance to corrosion.

8 Claims, 12 Drawing Sheets

Figure 1

Carbon Profiles of Low Alloy Steels Carburized at 1900F for Eight Hours

| Distance | 4330 V | 9310 |
|---|---|---|
| 0 | 1.21 | 1.12 |
| 0.1 | 1.17 | 1.09 |
| 0.2 | 1.19 | 1.05 |
| 0.3 | 1.18 | 1.14 |
| 0.4 | 1.17 | 1.05 |
| 0.5 | 1.19 | 1.03 |
| 0.6 | 1.35 | 1.04 |
| 0.7 | 1.2 | 1.05 |
| 0.8 | 1.19 | 1.06 |
| 0.9 | 1.15 | 1.02 |
| 1 | 1.16 | 1 |
| 1.1 | 1.15 | 0.96 |
| 1.2 | 1.21 | 0.98 |

Figure 2

Hardness Profiles of Low Alloy Steels Carburized at 1900F for Eight Hours

| Distance from Surface | 4330 V | 9310 |
|---|---|---|
| 0 | 57 | 57 |
| 0.1 | 61 | 63.5 |
| 0.2 | 61.5 | 58 |
| 0.3 | 58 | 60 |
| 0.4 | 59.5 | 57.5 |
| 0.5 | 60 | 60.5 |
| 0.6 | 61 | 61 |
| 0.7 | 60 | 61 |
| 0.8 | 60 | 60.5 |
| 0.9 | 61 | 62 |
| 1 | 61 | 61 |
| 1.5 | 62 | 59.5 |
| 2 | 61 | 53 |
| 2.5 | 56.5 | 48 |
| 3 | 54 | |
| 4 | 52 | |

Metallography and Topography of 4330V Carburized 8 Hours

Optical View of Carburized Surface

Etchant: 2% Nital 100 Magnifications

Optical View of Carburized Core

- - FIGURE 3 (CONTINUED) - -
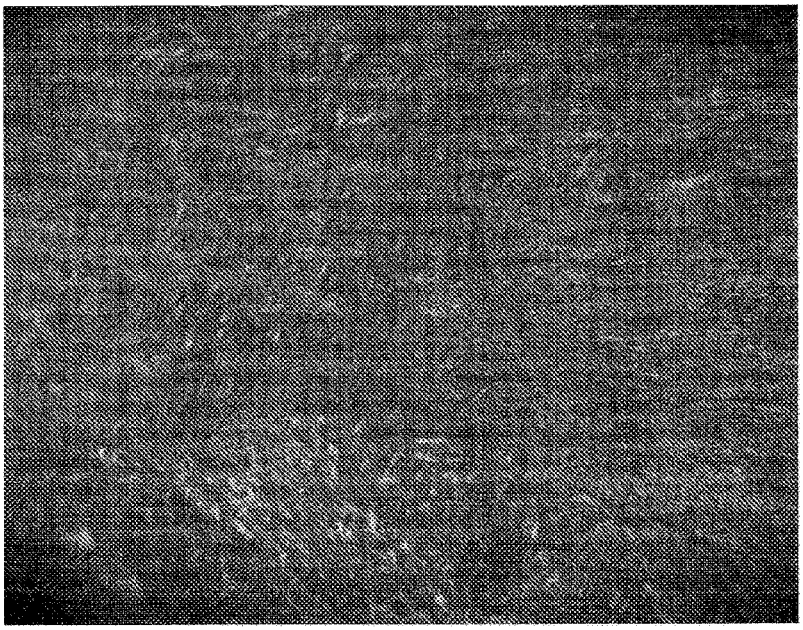
Etchant: 2% Nital 400 Magnifications

Figure 4

Carbon Profiles of Low Alloy Steels Carburized as a
Function of Time at 1900F, 10 Bar Quench, Stabilized and Tempered

| Distance from Surface | 8 hrs. | 7 hrs. | 6 hrs | 5 hrs | 4 hrs | 3 hrs | 2 hrs. | 1 hr. |
|---|---|---|---|---|---|---|---|---|
| | | | | 4330 V | | | | |
| 0 | 1.21 | 1.14 | 1.35 | 1.07 | 1.01 | 0.97 | 1.03 | 0.70 |
| 0.1 | 1.17 | 1.04 | 1.09 | 1.08 | 0.96 | 0.93 | 0.85 | 0.69 |
| 0.2 | 1.19 | 1.07 | 1.09 | 1.14 | 0.99 | 0.92 | 0.92 | 0.69 |
| 0.3 | 1.18 | 1.08 | 1.06 | 1.04 | 1.01 | 0.91 | 0.78 | 0.65 |
| 0.4 | 1.17 | 1.07 | 1.07 | 1.04 | 0.96 | 0.90 | 0.85 | 0.66 |
| 0.5 | 1.19 | 1.03 | 0.98 | 1.02 | 0.95 | 0.89 | 0.76 | 0.65 |
| 0.6 | 1.35 | 1.06 | 1.05 | 0.99 | 0.94 | 0.86 | 0.75 | 0.63 |
| 0.7 | 1.20 | 1.05 | 1.04 | 0.98 | 0.88 | 0.86 | 0.74 | 0.61 |
| 0.8 | 1.19 | 1.05 | 1.05 | 1.01 | 0.84 | 0.82 | 0.74 | 0.60 |
| 0.9 | 1.15 | 1.04 | 0.98 | 0.97 | 0.90 | 0.79 | 0.75 | 0.58 |
| 1 | 1.16 | 1.04 | 0.93 | 0.95 | 0.84 | 0.76 | 0.74 | 0.55 |
| 1.1 | 1.15 | 1.02 | 0.90 | 0.91 | 0.84 | 0.73 | 0.73 | 0.54 |
| 1.2 | 1.21 | 0.98 | 0.92 | 0.87 | 0.83 | 0.72 | 0.72 | 0.49 |
| | | | | 9310 | | | | |
| | 8 hrs | 7 hrs. | 6 hrs | 5 hrs | 4 hrs | 3 hrs. | 2 hrs | 1 hr. |
| 0 | 1.12 | 1.11 | 1.00 | 0.95 | 0.93 | 0.86 | 0.75 | 0.54 |
| 0.1 | 1.09 | 1.05 | 0.99 | 0.93 | 0.86 | 0.80 | 0.70 | 0.52 |
| 0.2 | 1.05 | 0.91 | 1.00 | 0.94 | 0.89 | 0.80 | 0.70 | 0.55 |
| 0.3 | 1.14 | 0.98 | 0.96 | 0.89 | 0.84 | 0.77 | 0.66 | 0.50 |
| 0.4 | 1.05 | 0.98 | 0.90 | 0.92 | 0.80 | 0.78 | 0.67 | 0.46 |
| 0.5 | 1.03 | 0.89 | 0.92 | 0.94 | 0.83 | 0.73 | 0.64 | 0.45 |
| 0.6 | 1.04 | 0.95 | 0.91 | 0.87 | 0.83 | 0.72 | 0.61 | 0.45 |
| 0.7 | 1.05 | 0.88 | 0.88 | 0.84 | 0.79 | 0.67 | 0.54 | 0.40 |
| 0.8 | 1.06 | 0.91 | 0.90 | 0.83 | 0.77 | 0.66 | 0.54 | 0.35 |
| 0.9 | 1.02 | 0.86 | 0.85 | 0.80 | 0.72 | 0.62 | 0.47 | 0.34 |
| 1.0 | 1.00 | 0.84 | 0.81 | 0.78 | 0.69 | 0.64 | 0.45 | 0.29 |
| 1.1 | 0.96 | 0.82 | 0.78 | 0.71 | 0.65 | 0.54 | 0.41 | 0.27 |
| 1.2 | 0.98 | 0.78 | 0.74 | 0.65 | 0.62 | 0.55 | 0.38 | 0.26 |

Figure 5

Hardness Profiles of Low Alloy Steels Carburized as a Function of Time at 1900F, 10 Bar Quench, Stabilized and Tempered

4330 V

| Distance From Surface- 0.1 mm | 8 | 7 | 6 | 5 | 4 | 3 | 2 | 1 |
|---|---|---|---|---|---|---|---|---|
| 0 | 57 | 63 | 68.5 | 69 | 60.5 | 62.5 | 64 | 45 |
| 0.1 | 61 | 60 | 63 | 61.5 | 64 | 63 | 61 | 47 |
| 0.2 | 61.5 | 60.5 | 58.5 | 60.5 | 62 | 62 | 61.5 | 47 |
| 0.3 | 58 | 58.5 | 58 | 62.5 | 62 | 64 | 62.5 | 50 |
| 0.4 | 59.5 | 59 | 58 | 62 | 62 | 62 | 62 | 50 |
| 0.5 | 60 | 61 | 60 | 61.5 | 61 | 62.5 | 62 | 48 |
| 0.6 | 61 | 60.5 | 60 | 63 | 61.5 | 62 | 62.5 | 49.5 |
| 0.7 | 60 | 62.5 | 62 | 63 | 61.5 | 61.5 | 61.5 | 51 |
| 0.8 | 60 | 60 | 61.5 | 61 | 62.5 | 61 | 60.5 | 47.5 |
| 0.9 | 61 | 62.5 | 62 | 62 | 62 | 60.5 | 60 | 49.5 |
| 1 | 61 | 59.5 | 63 | 60.5 | 62.5 | 61 | 59.5 | 48 |
| 1.5 | 62 | 61 | 61 | 60 | 60.5 | 54 | 54.5 | |
| 2 | 61 | 58.5 | 58.5 | 55.5 | 53 | | | |
| 2.5 | 56.5 | 55 | 55 | 54.5 | 52 | | | |
| 3 | 54 | | | | | | | |
| 4 | 52 | | | | | | | |

9310

| Distance From Surface- 0.1 mm | 8 | 7 | 6 | 5 | 4 | 3 | 2 | 1 |
|---|---|---|---|---|---|---|---|---|
| 0 | 57 | 58.5 | 62.5 | 60.5 | 59.5 | 63 | 59.5 | 44 |
| 0.1 | 63.5 | 58.5 | 58.5 | 61 | 59.5 | 61 | 61.5 | 44 |
| 0.2 | 58 | 59.5 | 59.5 | 61 | 60.5 | 62 | 61 | 41.5 |
| 0.3 | 60 | 60.5 | 58.5 | 59.5 | 59.5 | 60 | 60.5 | 38 |
| 0.4 | 57.5 | 60.5 | 58.5 | 60 | 59.5 | 61 | 58 | 36 |
| 0.5 | 60.5 | 60.5 | 60 | 59 | 61.5 | 60.5 | 58.5 | 33 |
| 0.6 | 61 | 60.5 | 60.5 | 60.5 | 59.5 | 58.5 | 55.5 | 33.5 |
| 0.7 | 61 | 60.5 | 59 | 60 | 58.5 | 59 | 54 | 32.5 |
| 0.8 | 60.5 | 61 | 57 | 59.5 | 60 | 57 | 54 | 33.5 |
| 0.9 | 62 | 60.5 | 54.6 | 58.3 | 57.5 | 56.5 | 52 | 30 |
| 1 | 61 | 60.5 | 55 | 58.4 | 57 | 54.5 | 51.5 | 31.5 |
| 1.1 | | 61 | | | | | | |
| 1.2 | | 58.5 | | | | | | |
| 1.5 | 59.5 | 56.5 | | 54 | 48 | | | |
| 2 | 53 | | | | | | | |
| 2.5 | 48 | | | | | | | |

Figure 6

Carbon Profiles of Low Alloy Steels Carburized at 1900F for 8 Hours, 10 Bar Quench, Stabilized and Tempered

| Distance from | | 4330V | | | 9310 | |
|---|---|---|---|---|---|---|
| Surface- 0.1 mm | 5 min. | 3 min. | 1.5 min. | 5 min. | 3 min. | 1.5 min. |
| 0.0 | 1.21 | 1.08 | 0.70 | 1.12 | 0.94 | 0.46 |
| 0.1 | 1.17 | 1.04 | 0.56 | 1.09 | 0.94 | 0.44 |
| 0.2 | 1.19 | 1.04 | 0.56 | 1.05 | 0.95 | 0.45 |
| 0.3 | 1.18 | 1.05 | 0.55 | 1.14 | 0.94 | 0.40 |
| 0.4 | 1.17 | 1.10 | 0.54 | 1.05 | 0.92 | 0.42 |
| 0.5 | 1.19 | 1.01 | 0.53 | 1.03 | 0.92 | 0.38 |
| 0.6 | 1.35 | 1.02 | 0.53 | 1.04 | 0.90 | 0.36 |
| 0.7 | 1.20 | 1.01 | 0.54 | 1.05 | 0.87 | 0.34 |
| 0.8 | 1.19 | 0.98 | 0.51 | 1.06 | 0.87 | 0.32 |
| 0.9 | 1.15 | 0.98 | 0.49 | 1.02 | 0.85 | 0.32 |
| 1.0 | 1.16 | 0.98 | 0.50 | 1.00 | 0.82 | 0.30 |
| 1.1 | 1.15 | 0.97 | 0.46 | 0.96 | 0.82 | 0.26 |
| 1.2 | 1.21 | 0.91 | 0.44 | 0.98 | 0.80 | 0.25 |

Figure 7

Hardness Profiles of Low Alloy Steels Carburized at 1900F for 8 Hours, 10 Bar Quench, Stabilized and Tempered

| Distance from | 4330V | | | 9310 | | |
|---|---|---|---|---|---|---|
| Surface- 0.1 mm | 5 min. | 3 min. | 1.5 min. | 5 min. | 3 min. | 1.5 min. |
| 0.0 | 57 | 60.4 | 60.1 | 57 | 59.9 | 53.4 |
| 0.1 | 61 | 60.1 | 60.80 | 63.5 | 61.0 | 54.9 |
| 0.2 | 61.5 | 61.2 | 61.20 | 58 | 61.8 | 54.5 |
| 0.3 | 58 | 61.8 | 61.00 | 60 | 60.4 | 53.4 |
| 0.4 | 59.5 | 61.2 | 60.10 | 57.5 | 61.8 | 54.1 |
| 0.5 | 60 | 62.6 | 60.60 | 60.5 | 62.0 | 53.7 |
| 0.6 | 61 | 61.2 | 60.60 | 61 | 62.6 | 51.7 |
| 0.7 | 60 | 62.9 | 58.80 | 61 | 62.2 | 50.9 |
| 0.8 | 60 | 62.0 | 58.80 | 60.5 | 62.2 | 49.6 |
| 0.9 | 61 | 63.9 | 57.10 | 62 | 62.2 | 46.5 |
| 1.0 | 61 | 63.3 | 57.30 | 61 | 62.2 | 46.5 |

Figure 8

Core Properties of Carburized, Stabilized and Tempered Low Alloy Steels

| Property | 4330V | 9310 |
|---|---|---|
| Core Hardness-HRC | 32 | 30 |
| Ultimate Tensile Strength-psi | 262,000 | 145,000 |
| Yield Strength-0.2% offset-psi | 202,000 | 115,000 |
| Elongation - % in | 10 | 19 |
| Reduction of Area - % | 27 | 64 |
| Fracture Toughness - ksi-in$^{1/2}$ | 82 | 83 |
| Impact Strength - ft-lbs. | 19 | 47 |

Sand Abrasion Test of Low Alloy Steels

Dry sand rubber wheel abrasion test ASTM G65 Procedure (A)

| | |
|---|---|
| Machine: | Falex ATM S/N AT-88-019 |
| RPM: | 200 |
| Force: | 30 lb |
| Distance: | 2000 Revolutions |
| Media: | AFS 50-70 |

| Description | Initial Weight (g) | Final Weight (g) | Mass Loss (g) | Density ($g/cm^3$) | Vol. Loss ($mm^3$) |
|---|---|---|---|---|---|
| 440C | 191.5827 | 191.3360 | 0.2467 | 7.68 | 32.12 |
| 675 | 186.6584 | 186.1072 | 0.5512 | 7.68 | 71.77 |
| 9310 | 191.0658 | 189.4832 | 1.5826 | 7.68 | 206.07 |
| 4330V | 207.8082 | 206.4713 | 1.3369 | 7.68 | 174.08 |
| Metco12C | 165.7670 | 165.3056 | 0.4614 | 7.68 | 60.08 |

Volume loss $mm^3$

Figure 10

Weight Loss Comparison of Tested Carburized Specimens

Crossed Cylinder Wear Test

Machine: BLCCFix (M)
RPM: 125
Force: 45 kg
Duration: 5400 Revolutions
Cylinder pat 83 mm
Cylinder Ma Wire Rope
Cylinder Ma Various (Customer Supplied)

| Sample ID | Cylinder Material Initial Mass (g) | Cylinder Material Final Mass (g) | Cylinder Material Mass Loss (g) |
|---|---|---|---|
| Carburized 9310 | 44.8080 | 44.7990 | 0.0090 |
| Pyrowear 675 | 50.1051 | 50.1016 | 0.0035 |
| Carburized 440C | 49.5793 | 49.5777 | 0.0016 |
| Carburized 4330V | 50.5486 | 50.5426 | 0.0060 |
| Metco 12C | 82.8549 | 82.8338 | 0.0211 |

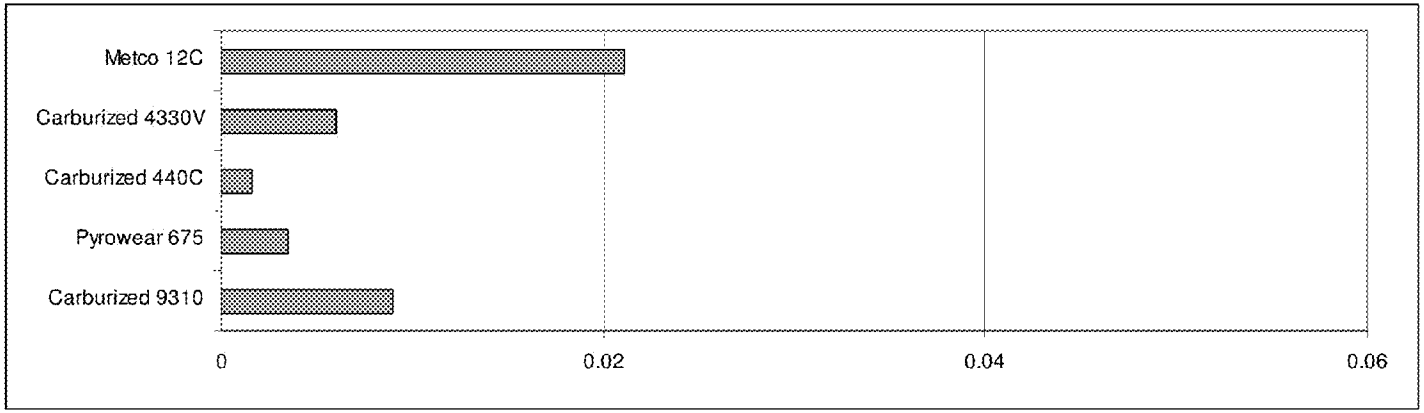

Figure 11

Rate of Corrosion of Specimens Immersed In A 5% Salt Solution for 240 Hours

| Alloy | Weight Loss- gm | | % Change | |
|---|---|---|---|---|
| | 8 hrs | 7 hrs | 8 hrs | 7 hrs |
| Pyrowear 676 | 0.1812 | 0.0738 | 0.0020 | 0.0009 |
| 440 C | 0.2048 | 0.1317 | 0.0017 | 0.0011 |
| 4330 V | 0.0751 | 0.2435 | 0.0017 | 0.0004 |
| 9310 | 0.500 | 0.100 | 0.0007 | 0.0018 |
| Metco 12C | 0.0041 | | 0.005 | |

LOW ALLOY STEEL CARBURIZATION AND SURFACE MICROALLOYING PROCESS

CROSS-REFERENCE TO RELATED APPLICATIONS

This application is a continuation-in-part of U.S.S. N. 13/336,723, now U.S. Pat. No. 8,696,830, that was fled on Dec. 23, 2011 which is a continuation-in-part of U.S.S. N. 12/971,068, now U.S. Pat. No. 8,425,691 that was filed on Dec. 17, 2010 that claims the benefit of priority of U.S. Provisional Appln. No. 61/366,477 filed on Jul. 21, 2010.

This invention was made with United States government support under Naval Air (NAVAIR) Contract No. N68335-10-C-0173. The Government has certain rights in this invention.

FIELD OF THE INVENTION

The present invention relates generally to industrial coatings used in the protection of metal surfaces and methods for the application of said coatings onto said metal surface. More specifically, the present invention relates to the coating of iron-based and stainless steel surfaces for the protection thereof against wear, the weather and other external environmental elements.

BACKGROUND OF THE INVENTION

Modern jet aircraft, particularly those employed in the Navy require improved tail hook material in order to arrest the craft during carrier and field carrier landing practice. In arresting the craft, friction and thermal loading results from engagement and as the tail-hook engages and slides when mating the arresting cable. Current materials and protective surfaces are not easily manufactured and associated processing is time consuming and costly. Therefore, there have been attempts to develop new innovative alloys and processes that will be more cost and energy effective while improving performance in arresting modern aircraft. Of particular interest are the wear and corrosion resistance of surfaces that mate and slide while the arresting gear tail hook engages and arrests the aircraft. It would be beneficial then to develop a material and processing that would not require external processing to protect or minimize the engaging surface against wear and corrosion. The characteristics of the alloy should also satisfy internal properties required and characteristic of a stainless steel alloys.

One goal of the present invention is to develop a process for an improved performance steel using high temperature carburizing or nitriding for improved wear resistance with improved corrosion resistance in respect to stainless and low alloy steels without compromising internal base properties. To this end, a primary objective was to develop a carburization process that would provide a hard, wear resistant surface that would in addition provide the corrosion resistance similar to that of martensitic stainless steel. This is accomplished by using the inherent protection of the chromium to enhance the wear resistance by formation of protective carbides, in addition to the properties afforded by martensitic formation of the base surface without sacrifice of the corrosion resistance provided by the chromium addition to the martensitic stainless steel.

Stainless steels may be classified by their crystalline structure into three main types: Austenitic, Ferritic and Martensitic. Martensitic steels are low carbon steels comprising a composition of iron, 12% chromium, and 0.12% carbon.

They may be tempered and hardened. Martensitic steel possesses great hardness and strength, but has reduced toughness and is less ductile, so few steels are fully hardened. Martensite is formed by the rapid cooling (quenching) of austenite which traps carbon atoms that do not have time to diffuse out of the crystal structure. This martensitic reaction begins during cooling when the austenite reaches the martensitic steel start temperature ($M_s$) and the parent austenite becomes mechanically unstable. At a constant temperature below $M_s$, a fraction of the parent austenite transforms rapidly and then no further transformation will occur. When the temperature is decreased, more of the austenite transforms to martensite. Finally, when the martensite finish temperature ($M_f$) is reached, the transformation is complete. Martensite can also form by application of stress (this property is frequently used in toughened ceramics like yttria—stabilized zirconia and in special steels like TRIP steels (i.e. transformation induced plasticity steels). Thus, martensite can be thermally—induced or stress—induced.

Austenite (or gamma phase iron) is a metallic, non-magnetic allotrope of iron or a solid solution of iron, with an alloying element, such as ferric carbide or carbon in iron, used in making corrosion-resistant steel. In plain-carbon steel, austenite exists above the critical eutectoid temperature of 1,000° K (730° C.); other alloys of steel have different eutectoid temperatures. Its face-centered cubic (FCC) structure allows it to hold a high proportion of carbon in solution. As it cools, this structure either breaks down into a mixture of ferrite and cementite (usually in the structural forms pearlite or bainite), or undergoes a slight lattice distortion known as martensitic transformation. The rate of cooling determines the relative proportions of these materials and therefore the mechanical properties (e.g. hardness, tensile strength) of the steel. Quenching (to induce martensitic transformation), followed by tempering (to transform some martensite and retained austenite, is the most common heat treatment for high performance steels. The addition of certain other metals, such as manganese and nickel, can stabilize the austenitic structure, facilitating heat-treatment of low-alloy steels. In the extreme case of austenitic stainless steel, much higher alloy content makes this structure stable even at room temperature. On the other hand, such elements as silicon, molybdenum, and chromium tend to de-stabilize austenite, raising the eutectoid temperature (the temperature where two phases, ferrite and cementite, become a single phase, austenite).

Austenite can contain far more carbon than ferrite, between 0.8% at 1333° F. (723° C.) and 2.08% at 2098° F. (1148° C.). Thus, above the critical temperature, all of the carbon contained in ferrite and cementite, (for a steel of 0.8% C) is dissolved in the austenite.

One of the differences between the two phases is that martensite has a body centered tetragonal crystal structure, whereas austenite has a face center cubic (FCC) structure. The transition between these two structures requires very little thermal activation energy because it is a martensitic transformation, which results in the subtle but rapid rearrangement of atomic positions, and has been known to occur even at cryogenic temperatures. Martensite has a lower density than austenite, so that the martensitic transformation results in a relative change of volume.

Carburization is the introduction of additional carbon to the surface of a steel part in order to affect case hardening. In gaseous carburizing, an endothermic gas, which contains carbon monoxide and hydrogen, is used as a carrier gas to displace the air in the furnace. A hydrocarbon-containing gas such as natural gas, propane or butane is added to the endothermic gas in varying quantities. The carbon monoxide from the endothermic gas and the hydrocarbon react to form nascent carbon atoms, which in turn react with the iron in the steel to form iron carbide. The iron carbide provides the hard surface.

The steel is exposed to the carburizing atmosphere at high temperatures, e.g., temperatures in the austenitic range for the steel in question, for a predetermined time to achieve the desired depth of carbon penetration into the steel surface. This depth is called the depth of the case. Carburized or case hardened steel has many important uses because of its desirable properties. The case provides the steel with hardness and wear resistance at the surface while the inner portion, or core, beyond the case is relatively soft and ductile. Therefore, case hardened steel has excellent wear properties in combination with the toughness of the core.

In conventional gas carburizing furnaces, a carburizing atmosphere is force circulated by a fan system over the steel in the chamber at atmospheric pressures. Usually, a hydrocarbon gas, such as is found in natural gas, is utilized in combination with a carrier gas, such as an endothermic gas, as the carburizing atmosphere. The carburizing atmosphere is circulated in the furnace for a predetermined time and under predetermined conditions to carburize the steel. The various ramifications and modifications of this technique are well known to those skilled in the art.

Carburization of steel involves a heat treatment of the metallic surface using a gaseous, liquid, solid or plasma source of carbon. Early carburization techniques used a direct application of charcoal packed onto the metal (initially referred to as case hardening or Kolsterizing), but modern techniques apply carbon-bearing gases or plasmas (such as carbon dioxide, methane, acetylene, etc.). The process depends primarily upon ambient gas composition and furnace temperature, which must be carefully controlled, as the heat may also impact the microstructure of the rest of the material. For applications where great control over gas composition is desired, carburization may take place under very low pressures in a vacuum chamber.

Plasma carburization is increasingly used in major industrial regimes to improve the surface characteristics (such as wear and corrosion resistance, hardness and load bearing capacity, in addition to quality-based variables) of various metals, notably stainless steels. The process is used as it is environmentally friendly (in comparison to gaseous or solid carburization). It also provides an even treatment of components with complex geometry (the plasma can penetrate into holes and tight gaps), making it very flexible in terms of component treatment.

The process of carburization works via the implantation of carbon atoms into the surface layers of a metal. As metals are made up of atoms bound tightly into a metallic crystalline lattice, the implanted carbon atoms force their way into the crystal structure of the metal and either remain in solution (dissolved within the metal crystalline matrix (this normally occurs at lower temperatures) or react with the host metal to form ceramic carbides (normally at higher temperatures, due to the higher mobility of the host metals' atoms). Both of these mechanisms strengthen the surface of the metal, the former by causing lattice strains by virtue of the atoms being forced between those of the host metal and the latter via the formation of very hard particles that resist abrasion. However, each different hardening mechanism leads to different solutions to the initial problem. The former mechanism, known as solid solution strengthening, improves the host metals' resistance to corrosion while increasing the alloys hardness. The latter, known as precipitation strengthening, greatly improves the hardness of the alloy but normally to the detriment of the host metals' corrosion resistance. Engineers using plasma carburization must decide which of the two mechanisms matches their needs.

There are different types of elements or materials that can be used to perform this process, but these mainly consist of high carbon content material. A few typical hardening agents include carbon monoxide gas (CO), sodium cyanide (NaCN) and barium chloride ($BaCl_2$), or hardwood charcoal. In gas carburizing, the CO is derived from a propane or natural gas source. In liquid carburizing, the CO is derived from a molten salt composed mainly of sodium cyanide and barium chloride. In pack carburization, the carbon monoxide source comes from coke or hardwood charcoal.

In oxy-acetylene welding, a carburizing flame is one with little oxygen, which produces a sooty, lower-temperature flame. It is often used to anneal metal, making it more malleable and flexible during the welding process. A main goal when producing carbonized work pieces is to insure maximum contact between the workpiece surface and the carbon-rich elements. In gas and liquid carburizing, the workpiece is often supported in mesh baskets or suspended by wire. In pack carburizing, the work piece and carbon are enclosed in a container to ensure that contact is maintained over as much surface area as possible. Pack carburizing containers are usually made of carbon steel coated with aluminum or heat-resisting nickel-chromium alloy and sealed at all openings with fire clay. In gas nitriding the donor is a nitrogen—rich gas usually ammonia ($NH_3$), which is why it is sometimes known as ammonia nitriding. When ammonia comes into contact with the heated work piece it disassociates into nitrogen and hydrogen. The nitrogen then diffuses from the surface into the core of the material. This process has been around for nearly a century though only in the last few decades has there been a concentrated effort to investigate the thermodynamics and kinetics involved.

U.S. Pat. No. 4,386,973 to Herring et. al. discloses and claims a process for carburizing steel comprising carburizing said steel under vacuum in a vacuum furnace in the presence of a hydrocarbon carburizing agent while utilizing as a carrier gas an aliphatic alcohol having 1 to 4 carbon atoms. The carburizing agent is supplied during said carburizing by cyclically reducing the pressure in the furnace followed by the addition of hydrocarbon carburizing agent to the furnace to replenish gas removed in the pressure reduction step.

The carburization process per se then, is not new technology. The standard process simply introduces carbon to the surface of a steel and relies on diffusion to transport the carbon internally from the surface into the interior. There are many methods developed to accomplish this using solid state carburization, such as pack carburization, traditional gas carburization and more recently, partial pressure gas carburization in vacuum furnaces. The later process has recently been successful in the carburization of traditional low alloy and tool steels. However, owing to the problem of grain growth, the carburization temperature is usually limited to the range of 845° C. to 950° C. This requires long periods of time in order to permit sufficient diffusion to occur so as to obtain the required depth of carburization to protect against wear. Standard set forth within the industry, such as the ASM Heat Treating Handbook and text books normally caution against exceeding a temperature of 1750° F. which will result in grain growth and deteriorate the core properties of the steel.

Carburization as is known in the prior art is currently limited to temperatures from about 1500° F. (816° C.) to about 1700° F. (927° C.).This is due to the occurance of grain growth of austenite in the steel core. It is known that to produce strong, tough ductile parts, grain size within the stainless or low alloy steel must be as fine as possible. It is therefore generally accepted theory that the carburization process temperature should be maintained lower than 1700° F. (927° C.) or austenitic grain growth will occur and may deteriorate the core properties of the part, i. e., tensile strength, yield strength, surface strength, and ductility thereby rendering the part useless in high stress situations. However, using the process of the present invention on low alloy steels such as 4330 V, 8620 and 9310, a harder, more wear and corrosion resistant surface is produced and achieved using higher temperatures which can carburize the steel in shorter periods of time.

SUMMARY OF THE INVENTION

The present invention comprises the carburization of low alloy steels with a gaseous carbon compound wherein the reaction pressure is lowered. This high temperature, partial pressure gas carburization is surprisingly discovered to be useful in the carburization of low alloy and the martensitic stainless steels. The process can use any carbonacious compound in any gaseous transport medium on low alloy steels and martensitic stainless steels at higher temperatures. This enables the deposit of nano-size carbon particles at higher temperatures upon an activated surface which increases the amount of carbon deposition and diffusion thereof. This results in significantly shorter cycles for deposition and diffusion for a required depth of carburization as known in the art.

BRIEF DESCRIPTION OF THE DRAWINGS

FIG. 2 is numerical data showing the hardness profiles of low alloy steels carburized as a function of time at 1900° F. (1040° C.), ten bar quenched, stabilized, and tempered.

FIG. 4 is numerical data showing the carbon profiles of low alloy steels carburized as a function of time at 1900° F. (1040° C.), ten bar quenched, stabilized, and tempered.

FIG. 5 is numerical data showing the hardness profiles of low alloy steels carburized as a function of time at 1900° F. (1040° C.), ten bar quenched, stabilized, and tempered.

FIG. 6 is numerical data showing the carbon profiles of low alloy steels carburized as a function of time at 1900° F. (1040° C.), ten bar quenched, stabilized, and tempered.

FIG. 7 is numerical data showing the hardness profiles of low alloy steels carburized as a function of time at 1900° F. (1040° C.), ten bar quenched, stabilized, and tempered.

FIG. 8 is numerical data showing the core properties of low alloy steels carburized as a function of time at 1900° F. (1040° C.), ten bar quenched, stabilized, and tempered.

FIG. 10 is numerical and graphical data showing the weight loss from abrasion simulating engagement of a hook point with a pendant upon landing of an aircraft on a carrier FIG. 11 is numerical data showing the rate of corrosion from five carburized low alloy steel samples immersed in a 5% salt solution for 200 hours.

DETAILED DESCRIPTION OF THE INVENTION

Figure 3:
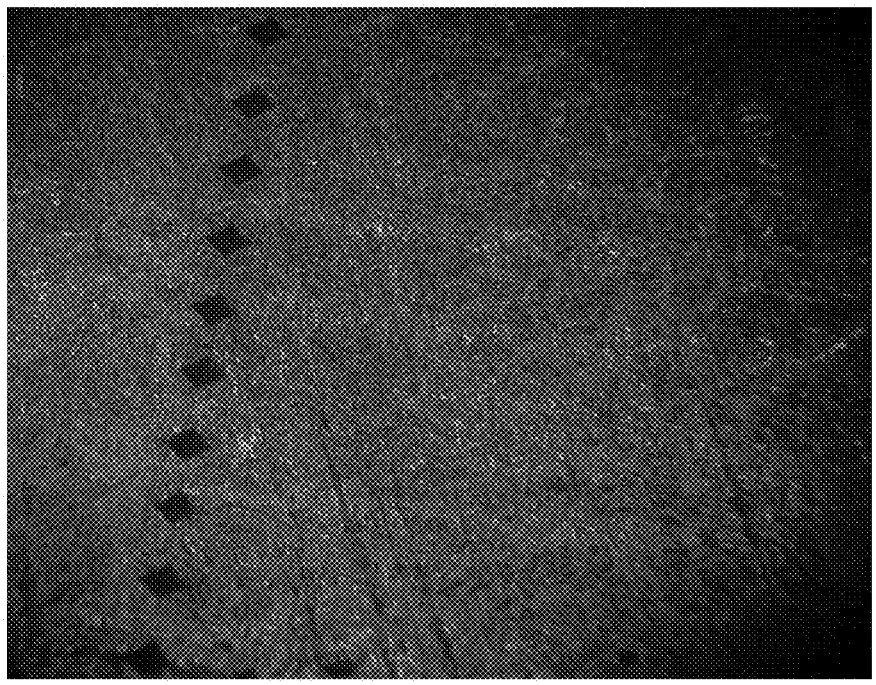
FIG. 3 is optical views showing the metallography and topography of a low alloy steel carburized for eight hours.

The present invention comprises a process for the carburization of low alloy or martensitic stainless steels with a gaseous carbon compound at partial pressure, which is herein defined as high temperature partial pressure gas carburization or surface micro-alloying. The process of the present invention can use any carbonacious compound in any gaseous transport medium to deposit nano-size carbon particles upon an activated steel surface at high temperatures. This enables a carburization process that requires significantly shorter cycles for deposition and diffusion for a required depth of carburization.

For the purpose of this application, the term "low alloy steels" are those steels that have a carbon content between 0.25-0.8 wt. % (m/o) to retain formability and weldability. Other alloying elements include up to 2.0% manganese and less than 1.0% copper, nickel, niobium, nitrogen, vanadium, chromium, molybdenum, titanium, calcium, rare earth elements, or zirconium. Copper, titanium, vanadium, and niobium are added for strengthening purposes. These elements are intended to alter the microstructure of carbon steels, which is usually a ferrite-pearlite aggregate, that produces a very fine dispersion of alloy carbides in an almost pure ferrite matrix. This eliminates the toughness-reducing effect of a pearlitic volume fraction yet maintains and increases the material's strength by refining the grain size, which in the case of ferrite increases yield strength by 50% for every halving of the mean grain diameter. Precipitation strengthening plays a minor role, too.

The low alloy steel 4330 V in the quenched and tempered condition exhibits excellent toughness. It is a modified version of grade 4330 with increased amounts of molybdenum and vanadium. The alloy modification provides increased hardeness into the core of the steel and improves the mechanical properties of larger sections. This material provides aircraft quality level steels such as AMS 2301/2304 which can be further heat treated to ASTM-A388/API 7.1 for the use and manufacture of jet landing tail hooks, gears, and any steel part used in a high stress/heat environment.

Alloy 9310 Aircraft Quality/Bearing Quality dual certified is an alloy comprising nickel, chromium and molybenubium (Ni—Cr—Mo) that is actually produced for the purpose of carburizing. It is a deep hardening steel, used for applications where strength, toughness, and high wear resistance are required. Alloy 9310 also achieves high core strength and toughness. Its excellent ductility and toughness make it a good choice for heavy sections and it is an alternative for applications using 4330 V that also require slightly higher core properties.

For certain low alloy steel applications, copper, silicon, nickel, chromium, and phosphorus are added to the steel in order to increase corrosion resistance. In other instances zirconium, calcium, and rare earth elements are added for sulfide-inclusion shape control which increases formability. These are needed because most low alloy steels have directionally sensitive properties. Formability and impact strength can vary significantly when tested longitudinally and transversely to the grain. Bends that are parallel to the longitudinal grain are more likely to crack around the outer edge whenever the steel experiences tensile loads. This directional characteristic is substantially reduced in low alloy steels that have been treated for sulfide shape control. These steels usually have densities of around 7.8 g/m$^3$.and are generally also more resistant to rust than most carbon steels because of a lower pearlite concentration—the fine layers of ferrite (almost pure iron) and cementite in pearlite.low alloy steels. They are also softer and less resistant to the external forces of heat, friction and stress that are common in aircraft environments The present invention then, comprises a process for surface hardening a low alloy steel, comprising the carburization of the steel in a vacuum furnace in the presence of a hydrocarbon carburizing gas in combination with hydrogen. The carburizing gas/hydrogen combination is administered to the vacuum furnace after evacuation of air from the furnace and introduction of a small amount or partial pressure of hydrogen gas to activate the surface during the initial heating cycle. Once the furnace achieves the selected carburizing temperature, a series of boost cycles takes place. These consist of the injection of an acetylene/hydrogen gas mixture at low pressure for a specified time, followed by a period wherein the carbon that is deposited on the surface of the steel is allowed to diffuse from the surface towards the steel core for a specified distance. The number of boost/diffusion cycles determines the total depth of steel carburization.

More specifically, the carburizing process of the low alloy steels comprises placing said low alloy steel in a vacuum furnace and then:

a. first creating a vacuum in said furnace by reducing the pressure through the removal of the air therein followed by the introduction of a partial pressure of hydrogen to activate the surface;
b. simultaneously raising the temperature of the furnace to a range of from about 1800° F. (980° C.) to about 2500° F. (1370° C.);
c. carburizing said low alloy steel in the vacuum furnace by the pulsed addition of a hydrocarbon carburizing gas selected from the group consisting of acetylene, methane and mixtures thereof in combination with hydrogen in an amount of from about 1 to 10 torr;
d. after each pulsed cycle of the hydrocarbon/hydrogen mixture, continuing the high temperature heating of the steel for a period of time that enables the dis-associated carbon deposited on the surface of the steel to diffuse inwardly towards the steel's core;
e. repeating the number of boost/diffuse cycles to obtain the desired depth of carburization, defined as a specific hardness for a given depth of consistent hardness, and
f. quenching the steel by rapidly reducing the temperature to a range of from about 2010° F. (1100° C.) to about 930° F. (500° C.) at an increased pressure of about 5 to 18 bar to transform the steel's core structure to untempered martensite.
g. placing the carburized and quenched steel parts in a cryogenic chamber and reducing the temperature of said chamber to −500° F. (−185° C.) for sufficient time thereby stabilizing the microstructure of said steel by transforming the retained austenite and stabling carbides;
h tempering the stabilized microstructure at the temperature necessary to develop the required core properties, and;
i. quenching the steel by rapidly reducing the temperature to a range of from about 1100° C. to about 500° C. at an increased pressure of about 10 barr to transform the steel's core structure to un-tempered martensite.

The hydrocarbon carburizing gas is selected from the group consisting of acetylene and methane and is preferably acetylene. The acetylene/hydrogen mixture is a hydrocarbon/carburizing gas which is injected into said furnace through a pulsed injection in a ratio of from about 1:1 to about 1:10, and preferably the mixture is in a ratio of from about 1:9. The temperature within the furnace is raised from room or ambient temperature in a partial pressure of hydrogen to the selected carburizing temperature, at which point the hydrogen is removed from the furnace and the acetylene/hydrogen mixture is injected into the furnace at a pressure of from about 3 torr to about 10 torr. This step is then followed by allowing the carbon that is deposited on the steel surface to diffuse to a specified depth from the surface to the core for a specific minimum hardness according to the specified depth from the surface. A selective number of boost/diffuse cycles may be required to achieve the required depth of hardness. Preferably, the low alloy steel is carburized at a temperature of from about 1800° F. to about 2200° F. The carburization and diffusion steps described herein may be repeated any number of times depending upon the depth of carbon penetration desired within the steel. Preferably, the alloy is quenched after the final boost/diffusion cycle step by pressure quenching the furnace using a pressure of 5 to 20 bar to retain the quenched structure. The quenched steel alloy is further stabilized in a nitrogen bath at sub-zero temperatures. The stabilized microstructure must then be tempered at a designated temperature to provide the desired core hardness.

As opposed to carburization processes known in the art, in the process of the present invention, carbon from a hydrogen/acetylene gas mixture is deposited onto a low alloy steel in a vacuum furnace at partial pressure at temperatures not presently deemed possible or recommended owing to grain growth occurrance, resulting in degraded core properties.

If the low alloy steel is quenched quickly, the excess carbon in solution reacts with the carbide formers and the iron therein to form metallic carbides and cementite at the austenitic grain boundaries. The remaining carbon that is in solution, depending on the quench rate, transforms to martensite. If the retained austenite and the un-tempered martensite are then stabilized in a liquid nitrogen bath and subsequently tempered to obtain the designated core properties of the base material, a wear resistant surface with improved corrosion resistance is obtained. This then produces a surface on the alloy that provides improved wear resistance and corrosion resistance for heavy duty machine components, in particular, arresting gear tail-hook and landing gear components for naval aircraft. Whereas the standard carburization process known in the art requires a clean active surface for deposition of the atomic size carbon particles that result from the dissociation of acetylene or other carbon compounds, the process of the present invention relies on Brownian motion for the particles, dispersed in a partial pressure of hydrogen or other gas such as argon, to be transported efficiently to the activated surface of the part requiring a hard wear resistant surface. Once the carbon is deposited on the surface, a diffusion cycle is then required to transport the deposited carbon from the surface into the interior of the part.

The carburization process is dependent on two fundamental equations of state. These include Fick's second law: D=kt. This equation defines the carburization depth and is a function of the temperature selected for carburization and the total time for diffusion to result. The total time for diffusion includes a boost and a diffusion cycle. The second equation of importance is the ratio of the time permitted for the deposition of atomic carbon onto the surface to diffuse (td) into the alloy as a function of the time allotted for deposition of the atomic carbon on the surface (tb): R=td/tb. The remaining factor to consider is the flow rate which is determined as follows:

$$\text{Flow Rate} = C\ \text{required}/t_{boost} \times 0.0011\ \text{gC/cc acetylene}$$

These fundamentals hold for any material to be carburized.

The surface and core properties of low alloy steels such as 4330 V, 8620 and 9310 were carburized at 1900° F. (1040° C.), and quenched with 10 bar nitrogen pressure, stabilized and tempered. An analysis of the core properties indicates no degredation occurred in the required properties throughout. Although the steels are treated at 1900° F. (1040° C.) which by the above applied calculations would result in an expected 1.5 wt. % amount of carbon dissolved in the austenitic steel (m/o), it was surprisingly and unexpectedly found that 2.5 to 3.0 wt. % carbon (m/o) was dissolved in the austenite. Moreover, this process would be expected to produce cementite in the steel in addition to saturating the austenite.

The following examples are provided to more specifically set forth and define the process of the present invention. It is recognized that changes may be made to the specific parameters and ranges disclosed herein and that there are a number of different ways known in the art to change the disclosed variables. Whereas it is understood that only the preferred embodiments of these elements are disclosed herein as set forth in the specification and drawings, the invention should not be so limited and should be construed in terms of the spirit and scope of the claims that follow. For purposes of this application HRC shall refer to the steel samples' resistance to penetration. The test measures the relative hardness by pressing an indentor into the surface of the steel with a specific load and then measuring how far the indentor was able to penetrate.

EXAMPLE 1

Two low alloy steel cylinders (2" by 2") were carburized using eight boost/diffusion cycles consisting of the introduction of an acetylene/hydrogen mixture into the furnace for five minutes followed by a 55 minute diffusion cycle to permit diffuse the carbon from the surface into the interior. The temperature for the carburization was maintained at 1040° C. (1900° F.) throughout the total carburization period consisting of eight (8) one hour cycles as described above. At this temperature, a carbon content slightly in excess of an eutectoid low alloy steel would be deposited on the surface and grain growth would be minimized.

Figures 1, 9:
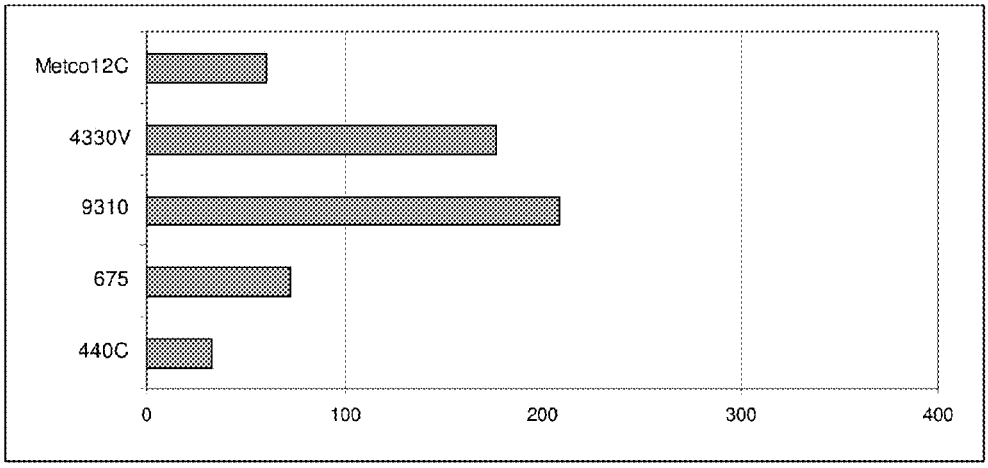
FIG. 1 is numerical data showing the carbon profiles of low alloy steels carburized as a function of time at 1900° F. (1040° C.), ten bar quenched, stabilized, and tempered.
FIG. 9 is numerical and graphical data showing the weight loss from abrasion of sand under a load, simulating landing of an aircraft on a carrier.

However, it is to be understood that it is advantageous to raise the temperature to expedite diffusion. The acetylene feed into the hydrogen carrier gas was 1.5 cc acetylene using hydrogen as the carrier gas at 8 torr total pressure. This provided a mixture of 18.75% acetylene to 81.25% hydrogen. In order to determine the depth of carburization required to obtain a minimum hardness of 58 HRC to a depth of 1 mm, the total time of carburization time was maintained at eight hours (eight (8) one hour boost/diffusion cycles). An initial boost of acetylene was provided for 5 minutes at a carburization temperature of 1040° C. This was followed by a diffusion cycle of 55 minutes for each hour for the total carburization time required. After the total carburizing time occurred, the cylinders were quenched to ambient temperature at 10 barr pressure. The cooling rate was of the order of one (1) minute to quench from 1040° C. to 540° C. At this cooling rate, it was presumed that all carbon present would be transformed to fine cementite and martensite. After quenching, chips were machined from the surface inward in 0.1 mm. intervals to determine the carbon profile after carburization. These optical micrograph profiles are included as FIG. 1. The stainless steel cylinder initially has a carbon concentration of about 1.2 m/o at the surface, which then diminishes as it diffuses inwardly as a function of time. Surprisingly, after an eight (8) hour carburization cycle, the carbon concentration is at least 1 m/o at a distance of 1 mm. from the surface, thereby satisfying the requirement for minimum hardness of 58 HRC. The hardness profile resulting from the carburization, 10 bar quench, stabilization and temper cycle of two low alloy steels is included as FIG. 2.

FIG. 3 shows the microstructure of the carburized surface and the core of the 4330 V low alloy steel after the carburization, 10 bar quench, stabilization and temper cycle. x-Ray diffraction data verifies this because the phases detected at the surface consist of cementite and martensite

EXAMPLE 2

Two low alloy steels were carburized under an acetylene boost of 1.5 cc at 8 torr pressure in hydrogen for five minutes followed by a diffusion time of 55 minutes at 1900° F. for one to eight cycles (one to eight hours total carburizing time) at 1040° C., 10 bar quenched, stabilized and tempered at 350° F. The carbon profiles show that as the number (9) of carburizing cycles (total time) diminishes, the amount of carbon deposited on the surface and diffused inward diminishes also. However, in two hours (two cycles) sufficient carbon is deposited and diffused on the 4330 V steel to comprise a eutectoid concentration. In the case of the 9310 low alloy steel, three hours (three cycles) is required.

FIG. 5 shows the hardness profiles of the two low alloy steels detailed above. This data confirms that a hardness greater than 60 HRC to a depth of 1.0 mm can be achieved in two (2) hours. Present carburization technologies known in the art require at least five times the processing time to achieve the same hardness profile. In the case of the 9310 steel, a hardness depth greater than 55 HRC to 1 mm is possible in two hours.

The previous example showed the depth of hardness that could be attained using carburization process technology known in the art. The second example exemplifies the cost savings (ROI) that can be achieved by the process of the present invention.

EXAMPLE 3

The effect that the carbon supply has on the degree of carbon deposition on the surface of the low alloy steel was examined. The carburization process previously described is followed (temp.=1900° F. for carburization and diffusion) the same acetylene fuel mixture and flow rate are utilized. However the time required at these conditions to deposit the atomized carbon in nanoform upon the surface of the low alloy steel was varied. Here, times of 1.5, 3 or 5 minutes were utilized as the time for the injection of the mixture in the selected concentration into the vacuum furnace. The balance of the process remains unchanged whereby an eight (8) hour cycle of eight one hour boost/diffusion times was used, followed by the 10 bar quench, stabilization and temper cycle of 350° F.

The carbon profiles resulting from processing under the conditions described above are included in FIG. 6. From this data, it is readily apparent that in order to deposit enough carbon to provide a composition of a eutectoid or hypereutectoid low alloy steel required only three minutes to produce a wear and corrosion resistant surface of greater than 60 HRC hardness to a depth of 1 mm. The 4330 V low alloy steel has slightly improved concentration because of the secondary hardening elements present in this modified grade of steel.

The hardness profiles resulting from the application of the carbon on the surface and the corresponding diffusion thereof is shown in FIG. 7. The data clearly demonstrate that a hardened, wear resistant, corrosion resistant surface with a hardness of greater than 60 HRC to a depth of 1 mm can be obtained by using a boost cycle time of 3 minutes. Also the 4330 V alloy, a microalloyed low alloy steel, acquires a surface with a hardness of greater than 55 HRC in merely 1.5 minute.

The Effect of Carburizing Cycles on Core Properties

It is obvious that any modification of the surface to improve hardness, wear and corrosion resistance must not alter the core properties of the low alloy steel. The core properties of these alloys, tempered at 350° F. are specified in ASTM Standards. After modifying the surface of the low alloy steels using the basic process described previously, the core properties were measured and are listed in FIG. 8. These core properties are in compliance with the ASTM Specifications and also for the application for which the steels are intended. Therefore it is important to note that the carburization process described herein is able to modify the low alloy steel surface in order to provide properties that markedly improve hardness, wear and corrosion resistance of the surface without altering required core properties, as specified for a given application.

Fracture Abrasion Test

A fracture abrasion test was made in order to determine the resistance to abrasion of the low alloy steels versus a hard faced steel using dry sand abrading the surface mating with a revolving rubber wheel according to ASTM Specification G65, Procedure A (5). The machine used was a Falex ATM S/N AT-88-019. The operating conditions were 200 r.p.m. with a 30 pound force for 2000 revolutions. The media for abrasion was AFS 50-70. Flow rate was 340 g/min.

Two low alloy steels were compared with two stainless steels, all carburized in accordance with the process of the present claimed invention. In addition, the four (4) specimens were compared with a 4330 V substrate that had been hard-faced using Metco 12C alloy to provide the hard wear and corrosion resistant surface. These test results are shown as FIG. 9. Secondly, the wear resistance of the two low alloy steels carburized using the above process was compared with two additional carburized martensitic stainless steels and a hard-faced surface customarily used to protect surfaces against abrasion such as sand. The results of this test are included as FIG. 9. Although the low alloy steels do not afford the abrasion resistance of the carburized martensitic stainless steels or the Metco 12c hard-faced surface, clearly it is evident that the corrosion resistance of the low alloy samples is significantly improved with respect to non-carburized surfaces. The difference in the performance is related to microstructure. In the case of the low alloy steels, the hard wear resistant surfaces consist of cementite and martensite, whereas the martensitic stainless steels and the hard-faced surface contain additional harder carbides. Although the wear resistance is not as good, the wear resistance is significantly improved and is more economical, and compared with the hard-faced surface, significantly less brittle.

FIG. 10 shows the wear resistance of the same alloys with the carburized or hard-faced surfaces described in the previous paragraph. In this case however, the coated steel surface intermittently intercepted a hard steel wire surface for a specified number of cycles. This behavior would be representative of a fatigue or impact (shock) experience as experienced by most rotating parts, such as gears and bearings under intermittent loads. In this case the more expensive martensitic stainless steels still experience improved wear resistance compared to the low alloy steels. However, the hard faced coating on the 4330 V substrate exhibited the least wear resistance by far.

Corrosion Resistance

The corrosion resistance of the carburized low alloy steels is compared with the corrosion resistance of the carburized martensitic stainless steels and the hard-faced 4300 V substrate in FIG. 11. The criteria for this test was that the material, with the respective carburized or hard-faced surface be suspended in a 5.0% salt solution for 240 hours. The specimen to be tested is first weighed before immersion and then after the 240 hour immersion time. Surfaces that were not carburized or hard-faced were coated with wax before immersion to prevent corrosion of these surfaces to bias the test results. It is important to note the % weight change resulting from the immersion time. In all cases, whether the specimen tested is a carburized or hard-faced stainless steel substrate or a low alloy steel substrate, corrosion weight loss is in the third decimal place and the inexactness of the measurement is in the fourth decimal place. Therefore the carburized low alloy steels indicate similar corrosion resistance as the martensitic stainless steels and five times the corrosion resistance of the hard-faced 4330 V substrate.

It is evident that a classical diffusion couple is in operation. There is an abundant supply of carbon at the surface and both the chromim and the molybdenum are most stable as carbides. Therefore, the atoms of these species migrate toward the surface and being more aggressive than iron, react to form the most stable carbide, or carbides, depending on the available concentration of carbon. What remains is then available for martensite formation, The surface strata then become rich in uniform carbides of chromium, molybdenum and iron. This is readily observed in the maps of the elements concentrated in the surface strata compared with the concentrations in the core, FIG. 9. .Note that chromium, molybdenum and vanadium, the carbide formers, are much more concentrated at the surface than in the core. However, the concentrations appear uniform within the microstructure and there is little evidence of grain boundaries. Although the mechanism for formation of the carburized surface is now apparent, there was insufficient time to make the same scan on the five inch diameter billet surface. Since the excess carbide formers had to come from some source it is postulated that the source is within the depleted region where grain growth and chromium, molybdenum and vanadium appear to be depleted, leaving a strata which is lower in hardness than the core, may be ferritic, rather than martensitic.

What I claim is:

1. A process for carburizing a low alloy steel in a vacuum furnace consisting of:

a. first creating a vacuum in said furnace by reducing the pressure through the removal of the air therein followed by the introduction of a partial pressure of hydrogen to activate the surface;

b. simultaneously raising the temperature of the furnace to a range of from about 1800° F to about 2500° F;

c. carburizing said low alloy steel in the vacuum furnace by the pulsed addition of a hydrocarbon carburizing gas selected from the group consisting of acetylene, methane and mixtures thereof in combination with hydrogen at a pressure of from about 1 to 10 torr;

d. repeating the number of pulsed addition gas carburizations to obtain the desired depth of carburization, defined as a specific hardness for a given depth of consistent hardness;

f. quenching the steel by rapidly reducing the temperature to a range of from about 2010° F (1100° C.) to about 930° F. (500° C.) at an increased pressure of about 5 to 18 bar to transform the steel's core structure to an untempered martensite;

g. placing the carburized and quenched steel in a cryogenic chamber and reducing the temperature of said chamber to −300° F(−185° C.) for sufficient time thereby stabilizing the microstructure of said steel; and h. tempering the stabilized microstructure of the steel by heating it to a temperature necessary to further develop the desired depth of carburization and core hardness.

2. The process as recited in claim 1 wherein said low alloy steels have a carbon content between about 0.25 to about 0.8 wt. % (m/o).

3. The process of claim 2 wherein said time sufficient is for a period that enables the disassociated carbon deposited on the surface of the low alloy steel to diffuse inwardly towards the low alloy steels' core.

4. The process as recited in claim 3 wherein said steel is carburized on its surface.

5. The process as recited in claim 4 wherein said hydrocarbon/carburizing gas is acetylene.

6. The process as recited in claim 5 wherein said acetylene/hydrogen mixture is in a ratio of from about 1:1 to about 1:10.

7. The process as recited in claim 6 wherein said acetylene/hydrogen mixture is in a ratio of from about 1:9.

8. The process as recited in claim 7 wherein said gas is introduced through a pulsed injection into a furnace atmospheric pressure of from 8 torr to 10 torr.

* * * * *